United States Patent [19]

Cooper, III

[11] Patent Number: 4,667,344

[45] Date of Patent: May 26, 1987

[54] FOUL WEATHER GARMENT

[76] Inventor: J. Robert Cooper, III, 690 Island Way, Clearwater, Fla. 33515

[21] Appl. No.: 684,665

[22] Filed: Dec. 21, 1984

[51] Int. Cl.[4] ..... A41D 1/02; A41D 1/06; A41D 13/00

[52] U.S. Cl. ..... 2/79; 2/82; 2/93; 2/227

[58] Field of Search ..... 2/DIG. 1, 82, 85, 93, 2/97, 2.1 R, 227, 79

[56] References Cited

U.S. PATENT DOCUMENTS 4,234,637 11/1980 Sewell et al. ..... 2/2.1 R X

FOREIGN PATENT DOCUMENTS 2522587 9/1983 France ..... 2/DIG. 1

337809 6/1959 Switzerland ..... 2/DIG. 1

*Primary Examiner*—H. Hampton Hunter

*Attorney, Agent, or Firm*—Stein, Reese & Prescott

[57] ABSTRACT

A foul weather garment permitting body perspiration to be vented to prevent accumulation of condensation including an outer garment shell, an inner garment liner and means for suspending the linear in the shell forming an air space therebetween so that perspiration vapors can condense within the air space and drain to the outside of the garment.

6 Claims, 5 Drawing Figures

FOUL WEATHER GARMENT

BACKGROUND OF THE INVENTION

1. Field of the Invention

This invention relates to foul weather garments. More particularly, this invention relates to foul weather garments characterized as permitting body perspiration to be vented therefrom to prevent condensation from accumulating within the foul weather garment.

2. Description of the Background Art

Presently there exists numerous types of foul weather garments which are each designed to be worn by a wearer during foul weather to shield the wearer from foul weather precipitation, such as rain, sleet, snow, fog or seaspray. The most basic type of foul weather gear usually consists of a rain coat and a bibbed trouser manufactured from water impermeable material such as a rubberized fabric or a urethane-coated fabric. The coat is worn over the bib and upper edges of the trousers so that precipitation impinging upon the rain coat flows off of the back and shoulder of the wearer down to the trousers. A hood is usually provided which is sewn to the collar of the coat to prevent precipitation impinging upon the wearer's head from flowing down inside of the coat via the neck opening. In other foul weather garments, the coat and trousers are manufactured as a one-piece garment, similar to a jumpsuit, having a zippered, or otherwise fastenable, front opening.

A properly manufactured foul weather garment as outlined above will, under virtually all circumstances, keep the wearer dry from precipitation. Unfortunately, a major disadvantage to these foul weather garments is the retention of human perspiration from the wearer of the garment. Specifically, the body perspiration of the wearer is trapped within the garment between the skin of the wearer and the waterproofed material of which the garment is constructed. This body perspiration, while initially in a vapor state, will condense on the inner surface of the garment and, consequently, dampen the wearer's other clothing. It can be readily appreciated that extended wear of such foul weather garments and the resulting large accumulation and condensation of body vapors will, eventually, completely wet the wearer's clothing.

In an effort to minimize condensation of body perspiration vapor, another type of foul weather garment was developed which included various vented openings. Most of these vented openings consisted of vents positioned within the underarm of the garment at the location at which the sleeve is connected to the body of the garment, while others also included a hooded vent positioned laterally along the width of the back panel of the garment. In each situation, the vents function to allow at least some body perspiration vapors to exit the garment prior to condensation. This type of garment was widely accepted throughout the industry as one solution to the problem of condensation. However, virtually none of these vented foul weather garments allowed the complete escape of all of the perspiration vapors. As a result, condensation and accumulation of body vapors within the garment would eventually occur and cause wetting of the wearer's clothing.

In recognition that vented foul weather garments could never vent all of the body vapors and that accumulation of moisture was inevitable, many attempts have been made to develop fabrics which allowed body vapors to pass therethrough while preventing precipitation such as rainfall and snowfall from passing through the fabric to wet the wearer. One specific type of such fabric is that disclosed in U.S. Pat. No. 4,234,637 entitled "Microporous Protective Coverings", issued to Sewell, et al., the disclosure of which is hereby incorporated by reference herein. The Sewell patent discloses a flexible, microporous, non-water-soluble, non-skin toxic film for use in protective garments such as diver's suits, foul weather suits and the like. The microporous film is characterized as having a porosity which permits the passage of body vapors in one direction while preventing, at least up to a modest external pressures, the counterpassage of water in the opposite direction. Foul weather garments manufactured from the fabric disclosed in the Sewell patent have accomplished the aforementioned desire to allow the passage of body vapors through the fabric of the garment. The garment also works reasonably well in prevent light precipitation impingeing upon the garment from passing through the film and wetting the wearer's clothing. Unfortunately, however, during heavy precipitation, a more than modest external fluid pressure is exerted on the fabric as each droplet of water impinges upon the same. This causes at least a portion of the droplet of water to actually force itself through the film and wet the wearer's clothing. Likewise, the fabric is subjected to more than modest external fluid pressures at stress points in the garment such as the top of the shoulders, the underarm, the seat of the pants, and at joints such as shoulder, elbow and knee joints. Consequently, precipitation is forced through the fabric at these points and, eventually, completely wets the wearer's clothing. A foul weather garment manufactured from this fabric, or similar fabrics, is, therefore, substantially limited in its use to non-vigorous, standing activity during light precipitation.

Therefore, it is an object of this invention to provide an apparatus which overcomes the aforementioned inadequacies of the prior art devices and provides an improvement which is a significant contribution to the advancement of the foul weather garment art.

Another object of this invention is to provide a foul weather garment which functions to prevent heavy precipitation and other moisture from wetting the clothing of the wearer of the garment.

Another object of this invention is to provide a foul weather garment which prevents condensing body perspiration vapors from wetting the wearer's clothing.

Another object of this invention is to provide a foul weather garment which is comfortably worn by the wearer without restriction or undue bulkiness.

Another object of this invention is to provide a foul weather garment which can be manufactured with conventional sewing equipment, thereby reducing the cost of manufacture of the same.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a foul weather garment manufactured from a waterproof material and having a liner loosely fitted therein. The waterproof material is characterized as being water impermeable at all external pressures to preclude moisture from flowing therethrough to the interior of the garment. The liner is characterized as being flexible, non-water-soluble, and capable of allowing passage of body vapors therethrough while preventing, at least up to modest external pressures, counterpassage of condensed body vapors. The liner conforms to the configuration of the garment, whether a coat, trousers or a jumper, and is sewn at strategic locations to the waterproof material of the garment only enough to retain the liner within the garment. The liner is also sewn to the seam of all of the upwardly disposed openings of the garment such as the neck and front opening of a coat garment, and the bib and waist opening of a trouser garments. All downwardly disposed openings, such as the sleeve cuffs and lower edge of a coat garment and the trouser leg bottom of a trouser or jumper garment, are left unsewn and merely tacked. During use, body perspiration vapors are permitted to flow through the liner into the air space between the waterproof material and the liner itself. As the perspiration vapor condenses and liquid forms on the inner surface of the waterproof material, the condensate flows down within such air space between the liner and the waterproof material until it exits the garment altogether via the downwardly disposed openings of the garment. Because the condensate is trapped between the liner and the fabric as it is not allowed to counterflow back through the liner onto the clothing of the wearer, it is clear that the clothing of the wearer will remain dry. Furthermore, due to the waterproof characteristic of the material itself, all precipitation such as rainfall is precluded from flowing through the material.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
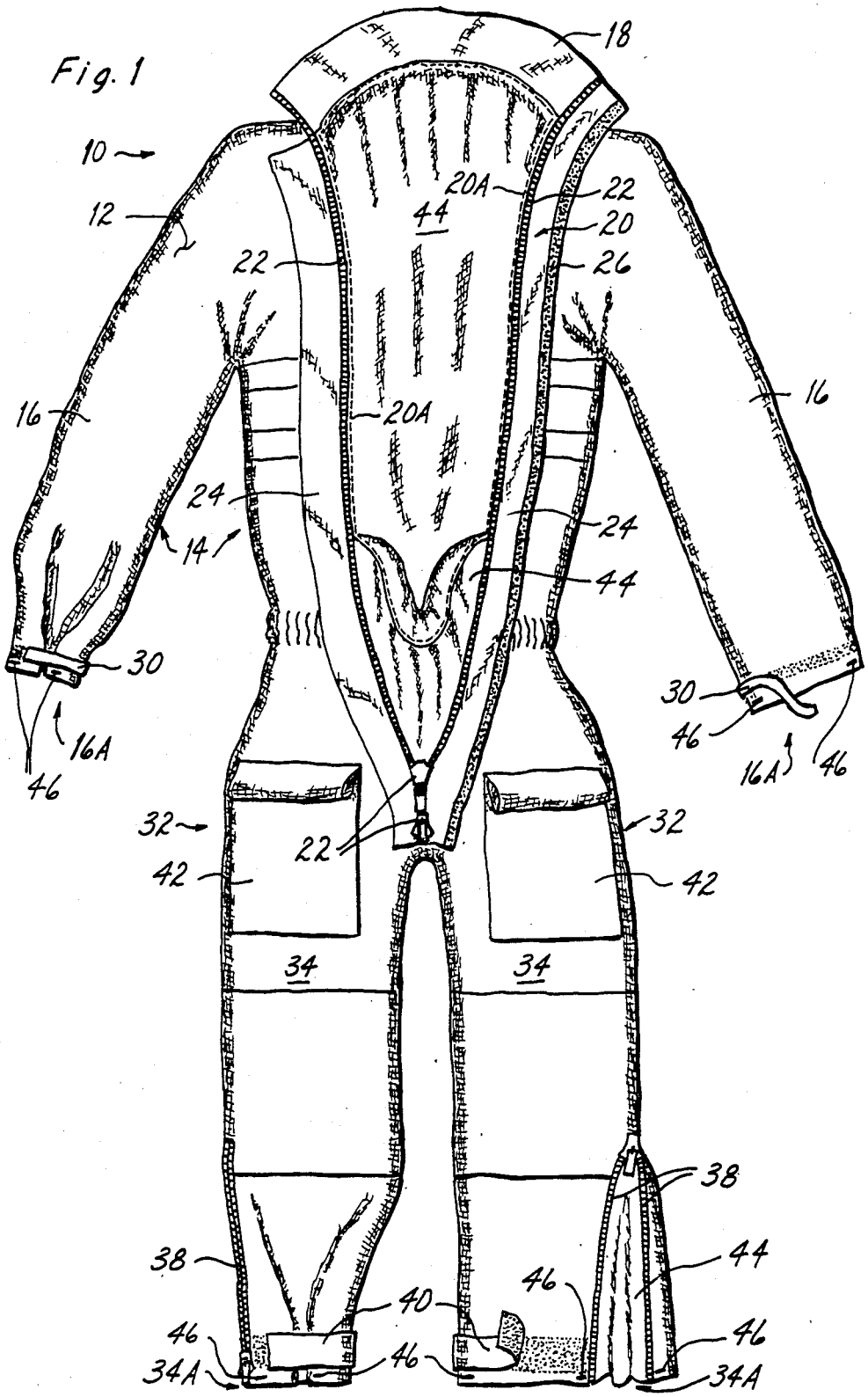
FIG. 1 is a front view of the foul weather garment of the invention illustrated as a jumpsuit with the outer fabric constituting a waterproof material or fabric and including a microporous liner fitted therein, with the liner being sewn to the upwardly disposed openings of the garment such as the neck and front opening.
Figure 4:
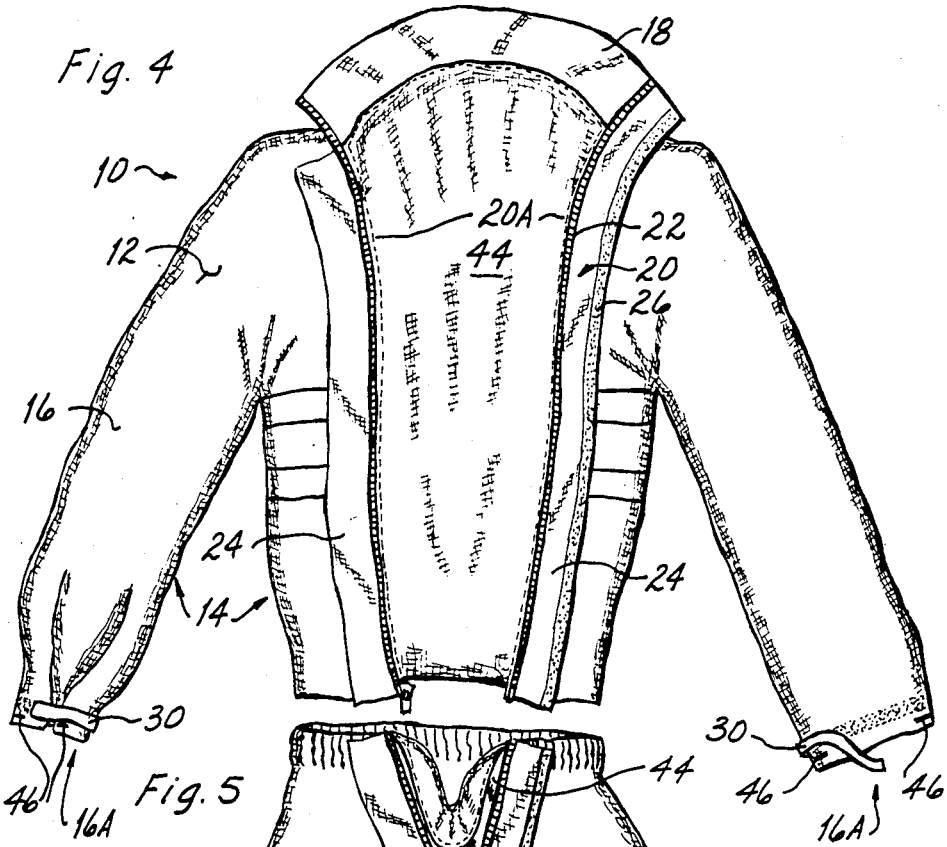
FIG. 4 is a front view of the foul weather garment of the invention illustrated as a jacket with the outer fabric constituting a waterproof material or fabric and includnig a microporous liner fitted therein, with the liner being sewn to the upwardly disposed opening of the garment such as the neck and front opening.
Figure 5:
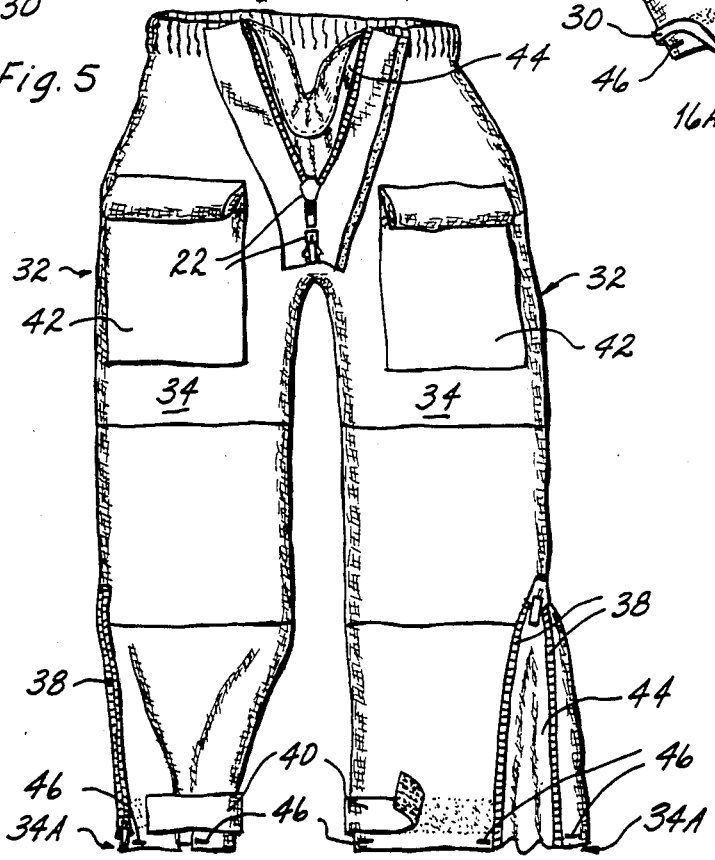
FIG. 5 is a front view of the foul weather garment of the invention illustrated as a pair of pants with the outer fabric constituting a waterproof material or fabric and including a microporous liner fitted therein, with the liner being sewn to the upwardly disposed opening of the garment as as the waist opening.

As illustrated in FIGS. 1, 4 and 5 the invention comprises a foul weather garment, generally indicated by the numeral 10, manufactured from a waterproof material or fabric 12 such as a rubberized fabric or a urethane-coated fabric. The garment 10 of the invention is illustrated as constituting a jumpsuit having an upper jacket (bodice) 14 with sleeves 16, collar 18 and front opening 20. A zipper 22 is sewn along the edges 20A of the opening 20 to provide access to and closure of the garment during wearing. Flaps 24 may be positioned about the opening 20 to prevent precipitation from entering the garment via zipper 22. The flaps 24 are designed to overlap one another and then be secured together by a continuous removable fastener 26 such as that sold under the trademark "Velcro". The lower sleeve openings 16A may be provided with a gathering strap 30 to allow close fitting of the opening 16A about the wrists of the garment wearer.

The garment 10 of the invention includes a trouser 32 having legs 34 and flared lower openings 34A at the end of the legs 34. The flared lower openings 34A may include a zippered closure 38 and gathering strap 40 which together tightly enclose the bottom opening 34A of the legs 34 about the wearer's boots or other footwear. The trouser portion 32 may include pockets 42 having upper openings which are rolled in upon themselves and fastened to the face of the pocket 42 by means such as a "Velcro" fastener.

The foul weather garment 10 of the invention further comprises a liner 44 loosely fitted on the interior of the garment 10 itself. More particularly, liner 44 includes a configuration and design substantially the same as the waterproof fabric 12 constituting the shell of the jumpsuit. The liner 44 is continuously sewn in an unbroken seam along all of the upwardly disposed openings of the garment 10. Specifically, the liner 44 is attached in an unbroken seam along the seam of the collar 18, joining the back panel of the jacket portion 14 and along the seam of opening 20A of the jacket portion 14. In FIG. 5, an unbroken seam extends about the waist and the fly openings of the pants 32. At all downwardly disposed openings of the garment 10, the liner 44 is left open with respect to such openings. However, the liner 44 may be tacked at various tack points 46 to simply assure that the liner 44 is retained in proper position relative to the fabric 12 as the garment 10 is worn by the wearer. Specifically, some of these tack points 46 are preferably positioned at the lower sleeve openings 16A and the flared lower trouser leg openings 34A of the trouser portion 32.

The liner 44 preferably is manufactured from such material or materials that can be characterized as allowing the passage of vapors therethrough but prevents, at least up to modest external fluid pressures, the counter-passage of liquids. One specific type of material which may constitute the liner 44 is that microporous material disclosed in U.S. Pat. No. 4,234,637 issued to Sewell, et al., the disclosure of which has been incorporated by reference herein. While this microporous material is preferable, it should be understood that other material(s) may be equally suitable for the purposes of liner 44 without departing from the spirit and scope of this invention. Furthermore, while a jumper-style foul weather garment is illustrated in FIG. 1, it shall be understood that the invention may also be incorporated in a jacket-type garment (FIG. 4), a pants-type garment (FIG. 5), a coat-type garment, a bibbed trouser-type garment or virtually any type of foul weather garment without departing from the spirit and scope of this invention.

Figure 2:
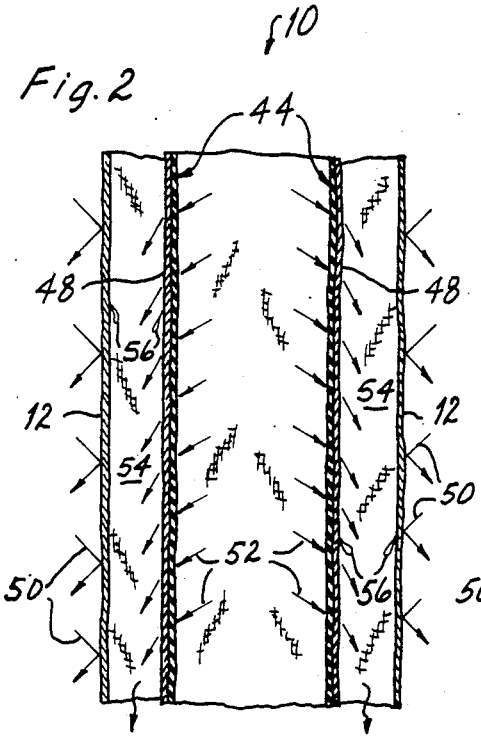
FIG. 2 is an enlarged, partial cross-sectional view of the garment of the invention illustrating the complete repelling of precipitation impingeing upon the outer fabric of the garment and the body vapors flowing through the microporous lining and condensing within the air space between the liner and the outer fabric.
Figure 3:
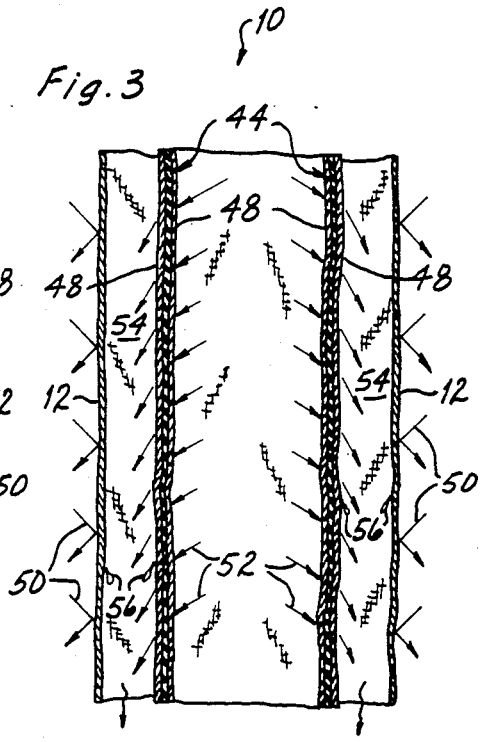
FIG. 3 is another enlarged, partial view of the garment of the invention in which the liner composed of a microporous film is encapsulated between a permeable fabric to protect the liner from abrasion during use.

As illustrated in FIG. 2, the liner 44 may be adhered to a permeable fabric 48 or, as illustrated in FIG. 3, the liner 44 may be completely encapsulated by a layer of permeable fabric 48 on opposing sides of the liner 44. The fabric(s) 48 function to provide a base for the liner 44 while additionally reducing abrasion effects on the liner 44 during wearing of the garment 10.

The foul weather garment 10 functions in the following manner to keep the wearer completely dry during use. Referring to FIGS. 2 and 3, all precipitation such as rainfall 50 is completely repelled by the waterproof fabric 12 constituting the outer shell of the garment 10. The body perspiration vapors existing within the liner 44 of the garment 10 from the wearer of the garment 10 is permitted to pass through the liner 44 as illustrated by arrows 52 and then into the air space 54 between the liner 44 and waterproof fabric 12. As the vapor represented by arrows 52 condenses on the inner surface of the waterproof fabric 12 or the outer surface of liner 44, the resulting droplets of moisture 56 flow downwardly within such air space 54 and are drained from the garment 10 via the openings 16A and 34A of the sleeves 16 and legs 34, respectively. In this regard, it is noted that the condensed perspiration vapor existing as droplets 56 are not subjected to more than modest external fluid pressure and, therefore, do not flow back through the liner 44 to wet the clothing of the wearer.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A foul weather jacket for wearing by a perspiring wearer, comprising in combination:

an outer jacket shell manufactured from a waterproof material, said outer jacket shell being configured in the form of a jacket having a torso portion, a neck opening portion, a pair of shoulder portions and a pair of opened arm portions;

an inner jacket liner manufactured from a liner material characterized as allowing water vapor to flow outwardly therethrough and as preventing, at least up to modest external pressures, the flowing of condensed water inwardly therethrough, said inner jacket liner being configured in the form of a jacket having a torso portion, a neck opening portion, a pair of shoulder portions and a pair of opened arm portions; and means for suspending said inner jacket liner in said outer jacket shell to create an air space therebetween, said suspension means comprising affixing together said neck opening portions of said outer jacket shell and said inner jacket liner such that perspiration vapors from the wearer flow outwardly through said inner jacket liner to said air space and, upon condensing to a liquid state within said air space, to drain from within said air space to exit the foul weather jacket.

2. The foul weather jacket as set forth in claim 1, further including means for tacking said inner jacket liner loosely within said outer jacket shell along said opened arm portions to facilitate removal of the jacket while maintaining said inner jacket liner within said outer jacket shell.

3. A foul weather pair of pants for wearing by a perspiring wearer, comprising in combination:

an outer pants shell manufactured from a waterproof material, said outer pants shell being configured in the form of a pair of pants having a trunk portion, a trunk opening portion, and a pair of opened leg portions;

an inner pants liner manufactured from a liner material characterized as allowing water vapor to flow outwardly therethrough and as preventing, at least up to modest external pressures, the flowing of condensed water inwardly therethrough, said inner pants liner being configured in the form of a pair of pants having a trunk portion, a trunk opening portion, and a pair of opened leg portions; and means for suspending said inner pants liner in said outer pants shell to create an air space therebetween, said suspension means comprising affixing together said trunk opening portions of said outer pants shell and said inner pants liner such that perspiration vapors from the wearer flow outwardly through said inner pants liner to said air space and, upon condensing to a liquid state within said air space, to drain from within said air space to exit the foul weather pair of pants.

4. The foul weather pair of pants as set forth in claim 3, further including means for tacking said inner pants liner loosely within said outer pants shell along said opened leg portions to facilitate removal of the pair of pants while maintaining said inner pants liner within said outer pants shell.

5. A foul weather jumpsuit for wearing by a perspiring wearer, comprising in combination:

an outer jumpsuit shell manufactured from a waterproof material, said outer jumpsuit shell being configured in the form of a jumpsuit having a torso portion, a neck opening portion, a pair of shoulder portions, a pair of opened arm portions, a trunk portion, a front opening portion, and a pair of opened leg portions;

an inner jumpsuit liner manufactured from a liner material characterized as allowing water vapor to flow outwardly therethrough and as preventing, at least up to modest external pressures, the flowing of condensed water inwardly therethrough, said inner jumpsuit liner being configured in the form of a jumpsuit having a torso portion, a neck opening portion, a pair of shoulder portions, a pair of opened arm portions, a trunk portion, a front opening portion, and a pair of opened leg portions; and means for suspending said inner jumpsuit liner in said outer jumpsuit shell to create an air space therebetween, said suspension means comprising affixing together said neck opening portions and said front opening portions of said outer jumpsuit shell and said inner jumpsuit liner such that perspiration vapors from the wearer flow outwardly through said inner jumpsuit liner to said air space and, upon condensing to a liquid state within said air space, to drain from within said air space to exit the foul weather jumpsuit.

6. The foul weather jumpsuit as set forth in claim 5, further including means for tacking said inner jumpsuit liner loosely within said outer jumpsuit shell along said opened arm portions and said opened leg portions to facilitate removal of the jumpsuit while maintaining said inner jumpsuit liner within said outer jumpsuit shell.

* * * * *